US010919655B2

(12) United States Patent
Stenvik et al.

(10) Patent No.: US 10,919,655 B2
(45) Date of Patent: Feb. 16, 2021

(54) PACKAGING SYSTEM AND METHOD OF PACKAGING PRODUCTS

(71) Applicant: General Mills, Inc., Minneapolis, MN (US)

(72) Inventors: Ralph A Stenvik, Plymouth, MN (US); Emil Bogdanov, Excelsior, MN (US); Thomas L Smith, Hendersonville, TN (US)

(73) Assignee: General Mills, Inc., Minneapolis, MN (US)

( * ) Notice: Subject to any disclaimer, the term of this patent is extended or adjusted under 35 U.S.C. 154(b) by 172 days.

(21) Appl. No.: 16/268,626

(22) Filed: Feb. 6, 2019

(65) Prior Publication Data

US 2020/0247567 A1 Aug. 6, 2020

(51) Int. Cl.

| | |
|---|---|
| ***B65B 55/00*** | (2006.01) |
| ***B65B 25/00*** | (2006.01) |
| ***B65B 5/04*** | (2006.01) |
| ***B65B 9/067*** | (2012.01) |
| ***B65B 31/04*** | (2006.01) |
| ***B65B 35/24*** | (2006.01) |
| ***B65B 41/16*** | (2006.01) |

(52) U.S. Cl.

CPC ..... *B65B 25/001* (2013.01); *B65B 5/04* (2013.01); *B65B 9/067* (2013.01); *B65B 31/048* (2013.01); *B65B 35/24* (2013.01); *B65B 41/16* (2013.01); *B65B 55/00* (2013.01)

(58) Field of Classification Search

CPC ..... B65B 9/067; B65B 31/00; B65B 31/04; B65B 31/042; B65B 31/044; B65B 31/046; B65B 31/048; B65B 55/00; B65B 55/04; B65B 55/10; B65B 55/103; B65B 55/106; B65B 55/12; B65B 55/18; B65B 41/00; B65B 41/16

USPC ..... 53/403, 405

See application file for complete search history.

(56) References Cited

U.S. PATENT DOCUMENTS

| | | | | |
|---|---|---|---|---|
| 3,274,746 A | | 9/1966 | James et al. | |
| 4,170,863 A | | 10/1979 | Schwanz | |
| 4,418,513 A | * | 12/1983 | Plahm | B65B 31/042 53/373.2 |
| 5,282,349 A | | 2/1994 | Siegel | |
| 5,341,623 A | * | 8/1994 | Siegel | B29C 66/81435 53/433 |
| 5,551,213 A | | 9/1996 | Koelsch et al. | |

(Continued)

FOREIGN PATENT DOCUMENTS

| | | |
|---|---|---|
| GB | 2250499 | 10/1992 |
| GB | 2325450 | 11/1998 |

*Primary Examiner* — Chelsea E Stinson

(74) *Attorney, Agent, or Firm* — Diederiks & Whitelaw, PLC; Gregory P. Kaihoi, Esq.

(57) ABSTRACT

A packaging system includes a first sealer and a gas flusher. The first sealer creates a first seal in packaging material along a direction of travel of the packaging material, thereby forming a packaging loop. The gas flusher flushes ambient air from the packaging loop and includes a mechanically retractable lance that can be selectively repositioned relative to the first sealer. When the mechanically retractable lance is in an operative position, the mechanically retractable lance projects into the packaging loop, with a gas flowing through the mechanically retractable lance into the packaging loop.

20 Claims, 5 Drawing Sheets

(56) References Cited

U.S. PATENT DOCUMENTS

| | | | | |
|---|---|---|---|---|
| 6,123,969 | A * | 9/2000 | Sjoberg | B65B 31/02 426/128 |
| 2005/0102975 | A1* | 5/2005 | Hughes | B65B 31/042 53/432 |
| 2006/0213153 | A1* | 9/2006 | Sanfilippo | B65B 31/045 53/511 |
| 2010/0257820 | A1 | 10/2010 | Doll et al. | |
| 2012/0031049 | A1 | 2/2012 | Doll et al. | |
| 2012/0279180 | A1* | 11/2012 | Crawford | B65B 31/045 53/432 |
| 2016/0096644 | A1* | 4/2016 | Murray | B65B 31/044 141/54 |
| 2016/0288937 | A1 | 10/2016 | Grether et al. | |
| 2017/0057671 | A1 | 3/2017 | Van Wandelen et al. | |

* cited by examiner

PACKAGING SYSTEM AND METHOD OF PACKAGING PRODUCTS

BACKGROUND OF THE INVENTION

The present invention pertains to the art of food production and, more particularly, to gas flushing packaging for food products.

Food products are often packaged prior to sale. Such packaging can take the form of wrappers, bags, cans, jars or boxes, for example. In some instances, ambient air within the packaging is flushed from the packaging prior to the packaging being sealed. This is done to help prevent the food products from spoiling due to the presence of oxygen in the ambient air.

One method for flushing ambient air from food product packaging involves the use of a lance that is inserted into the packaging. An inert gas, such as nitrogen, carbon dioxide or a mixture thereof, flows through the lance into the packaging, causing the ambient air within the packaging to be expelled prior to sealing the packaging. While such an arrangement is effective at flushing out the ambient air, the positioning of the lance can cause problems in the event of a packaging issue. For example, when wrapping food products using a continuous stream of wrapper, it is possible for the wrapper to become jammed. Since the lance projects into the wrapper, unjamming the wrapper can result in damage to the lance or, at the very least, a time consuming process involving carefully removing the wrapper from the lance and then later placing the wrapper back over the lance. With high speed packaging systems, this process may need to be performed multiple times a day, which reduces the number of food products that can be packaged per day. Furthermore, the cost to replace a damaged lance, such as a lance which is bent, is quite high.

In view of the above, it would be desirable to provide a gas flushing arrangement, utilizing a lance, where the time needed to deal with packaging issues is minimized. It would also be desirable to minimize the risk of damage to the lance when addressing such issues.

SUMMARY OF THE INVENTION

The present invention achieves the above goals by providing a mechanically retractable lance that can be moved out of the way when a worker is addressing a packaging issue, such as packaging material becoming jammed. This eliminates the need for the worker to carefully remove the packaging material from the lance and then later place the material back over the lance, speeding up the process and reducing the chance that the lance is damaged.

As discussed above, when packaging food products, it is often advantageous to flush ambient air from the packaging prior to the packaging being sealed. This can be accomplished using a lance that is inserted into the packaging, for example. However, the positioning of the lance can cause problems in the event of a packaging issue. In particular, the positioning of the lance makes dealing with packaging issues more time consuming and, if the lance is damaged, more expensive. The present invention was developed to address this problem. Specifically, the present invention provides a mechanically retractable lance that can be selectively positioned relative to the rest of the packaging system and, accordingly, relative to packaging material traveling through the packaging system. As a result, when a packaging issue arises, the lance can be repositioned so that it no longer projects into the packaging. This makes it easier to address the packaging issue, such as a jam, and minimizes the possibility of damaging the lance. Afterwards, the lance can be placed back into its operative position, where it projects into the packaging.

In one embodiment, a packaging system comprises a first sealer and a gas flusher. The first sealer is configured to create a first seal in packaging material along a direction of travel of the packaging material, thereby forming a packaging loop. The gas flusher is configured to flush ambient air from the packaging loop and includes the mechanically retractable lance configured to be selectively repositioned relative to the first sealer. When the mechanically retractable lance is in an operative position, the mechanically retractable lance projects into the packaging loop, with a gas flowing through the mechanically retractable lance into the packaging loop.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE INVENTION

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting but merely as a representative basis for teaching one skilled in the art how to construct and employ the present invention.

Figure 1:
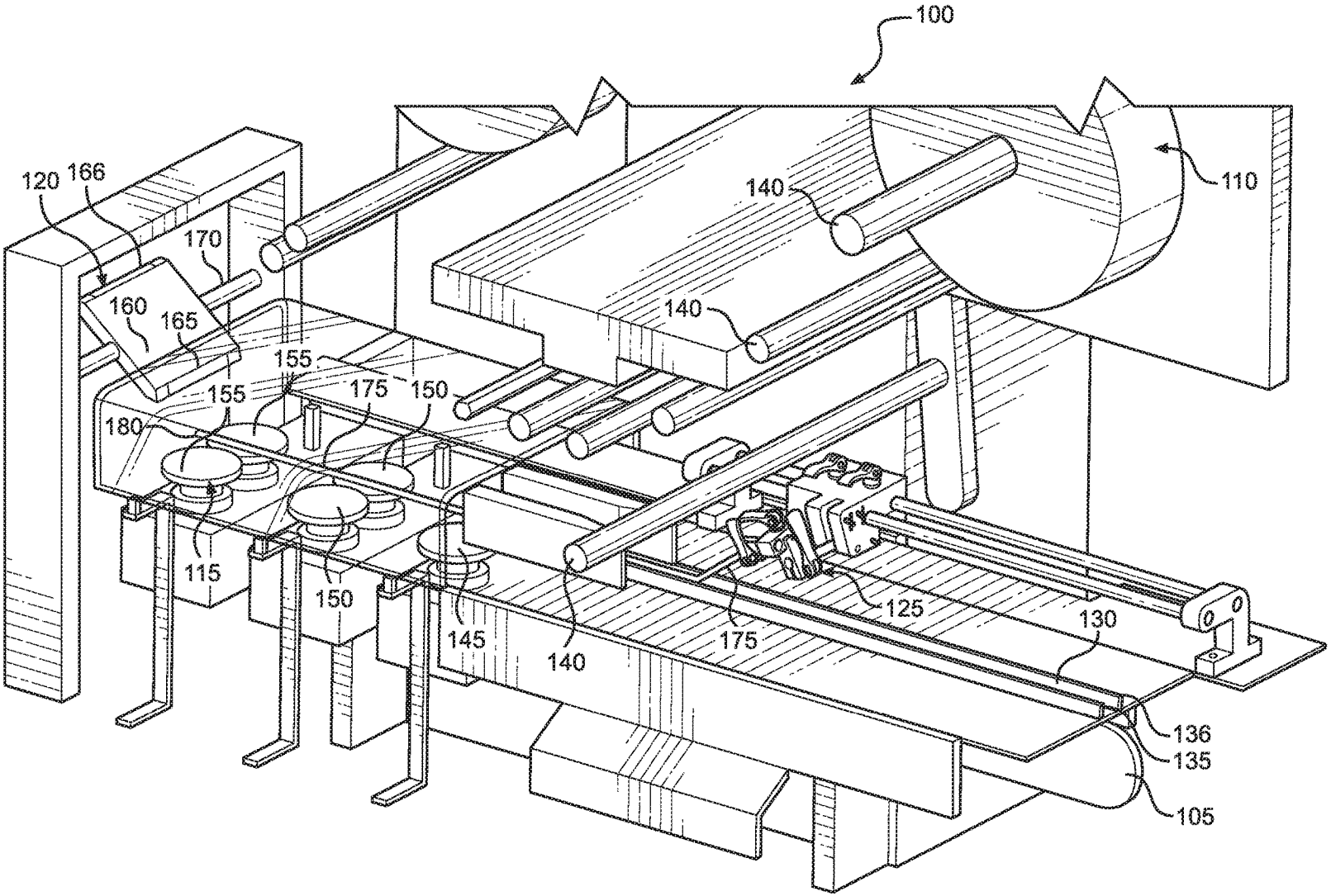
FIG. 1 is a perspective view of a packaging system constructed in accordance with the present invention, with a lance of the system in an operative position.
Figure 2:
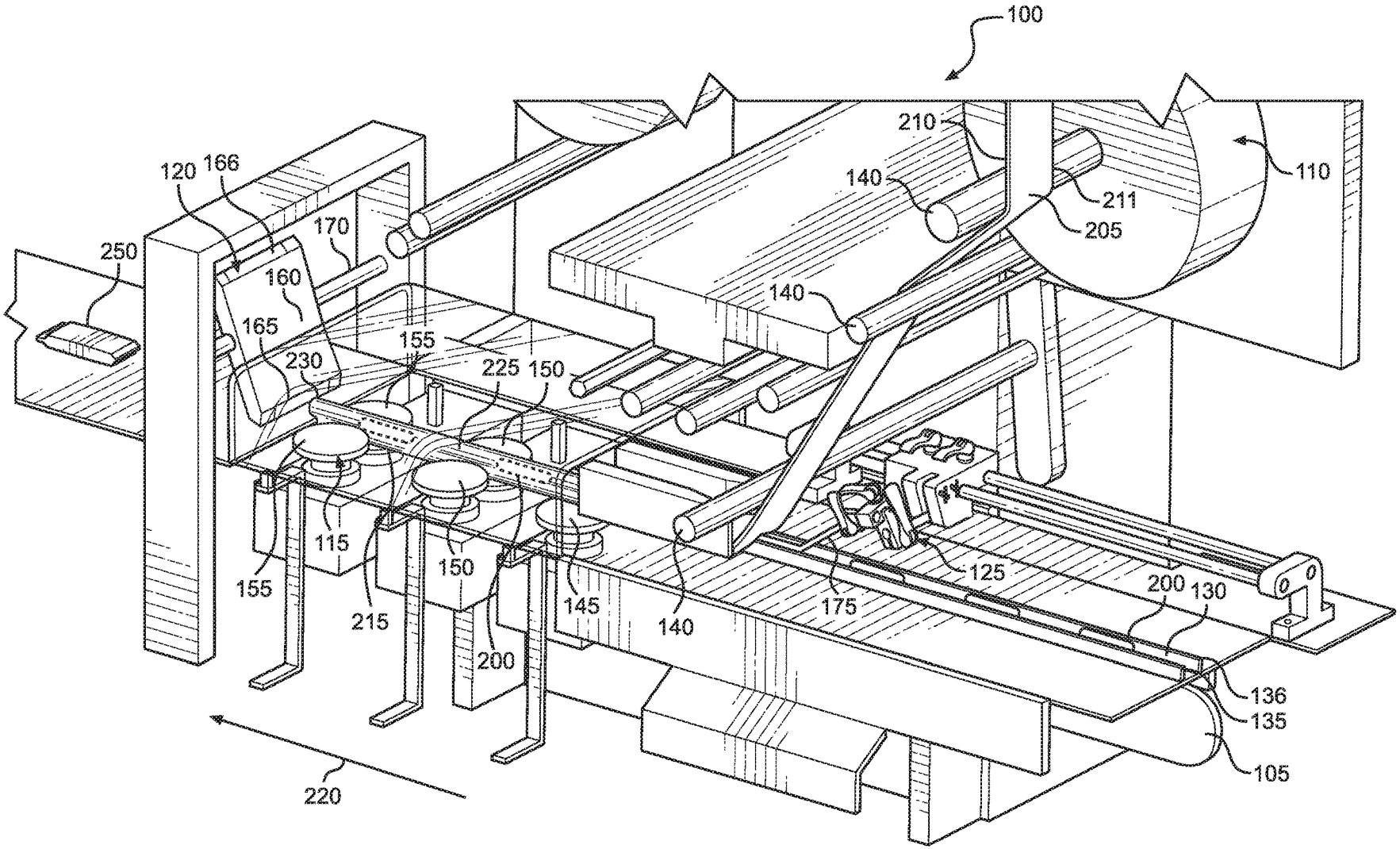
FIG. 2 is a perspective view of the system showing food products being packaged.

With reference to FIGS. 1 and 2, a packaging system 100, constructed in accordance with the present invention, is shown. Packaging system 100 includes a conveyor 105, a feeder 110, a first sealer 115, a second sealer 120 and a gas flusher 125. Portions of conveyor 105 have been removed to increase the visibility of certain parts of packaging system 100, particularly first sealer 115. However, it should be understood that, in practice, conveyor 105 would extend across first sealer 115 and beyond second sealer 120 to the left (relative to FIGS. 1 and 2). Conveyor 105 is configured to transport a plurality of food products 200 (shown in FIG. 2) through packaging system 100 from right to left. Specifically, food products 200 are transported along a channel 130, defined by upstanding walls 135 and 136, to first sealer 115. Packaging material 205 (shown in FIG. 2) for packaging food products 200 is also transported to first sealer 115.

In particular, feeder 110 is configured to feed packaging material 205 to first sealer 115 using a plurality of rollers 140.

Packaging material 205 begins as a sheet and is folded by packaging system 100 into the shape of a "U", as shown in FIG. 2. The ends of this "U", which correspond to first and second portions 210 and 211 of packaging material 205, are pressed into contact with one another between a first pair of wheels 145 of first sealer 115 (only one of which is visible in the drawings). A second pair of wheels 150 of first sealer 115 seals first and second portions 210 and 211 to one another to create a first seal 215 in packaging material 205 along a direction of travel 220 of packaging material 205. In one preferred embodiment, wheels 150 are configured to create a heat seal. As a result of the creation of first seal 215, first sealer 115 forms a packaging loop 225 around food products 200 being conveyed through packaging system 100. First sealer 115 also has a third pair of wheels 155, which are beveled in order to cause first seal 215 to be folded to one side as packaging loop 225 passes through wheels 155 such that the portion of packaging material 205 establishing first seal 215 will then sit flat against the bottom of packaging loop 225.

Although packaging system 100 is depicted as having three pairs of wheels 145, 150, 155, other wheel configurations can be used in accordance with the present invention. For example, the functions of wheels 145 and 150 can be combined in a cold-sealing arrangement, resulting in only two pairs of wheels. It should also be recognized that other sealing mechanisms known in the art can be used with the present invention.

Second sealer 120 is configured to create a second seal 230 in packaging loop 225 perpendicular to direction of travel 220 of packaging material 205. Specifically, second sealer 120 creates a series of second seals 230 as a sealing head 160, having sealing jaws 165 and 166, rotates about a shaft 170, thereby forming a plurality of individual packages 250. In addition, at any given moment, one of second seals 230 serves to close off the leftmost end of packaging loop 225 (relative to FIG. 2).

In accordance with the invention, gas flusher 125 is configured to flush ambient air from packaging loop 225 using a mechanically retractable lance 175, which is selectively repositionable relative to first sealer 115. When mechanically retractable lance 175 is in an operative position, as shown in FIGS. 1 and 2, mechanically retractable lance 175 projects into packaging loop 225, and a gas flows through mechanically retractable lance 175 into packaging loop 225. Since packaging loop 225 is sealed at one end by one of seals 230, the gas flowing into packaging loop 225 causes ambient air located within packaging loop 225 to flow away from this seal 230 and out of packaging loop 225. Preferably, the gas used is an inert gas, such as nitrogen, carbon dioxide or a mixture thereof. As a result, this flushing helps prevent food products 200 from spoiling due to the presence of oxygen in the ambient air, which would otherwise be trapped within individual packages 250 as seals 215 and 230 are formed. At this point, it should be noted that food products 200 are generally depicted as bars, such as energy bars, in FIG. 2. However, the present invention is also usable in connection with other types of food products whose packaging is gas flushed, such as meats, cheeses, and a wide range of snack products including potato chips and the like.

As can be seen in FIG. 1, mechanically retractable lance 175 extends vertically above first sealer 115 when mechanically retractable lance 175 is in an operative position. Mechanically retractable lance 175 also extends vertically above food products 200 in this position. Alternatively, mechanically retractable lance 175 can be positioned below or to one side of food products 200 when in an operative position. While only one operative position is shown in FIGS. 1 and 2, mechanically retractable lance 175 actually has multiple operative positions, determined by the position of a tip 180 of mechanically retractable lance 175. In general, tip 180 should be located between where seals 215 and 230 are created to ensure that the gas flowing from mechanically retractable lance 175 enters packaging loop 225 and that mechanically retractable lance 175 does not interfere with second sealer 120. Accordingly, in the embodiment illustrated, tip 180 should be located between second sealer 120 and the portion of wheels 150 where first seal 215 is created, with any of these positions being considered an operative position.

Figure 3:
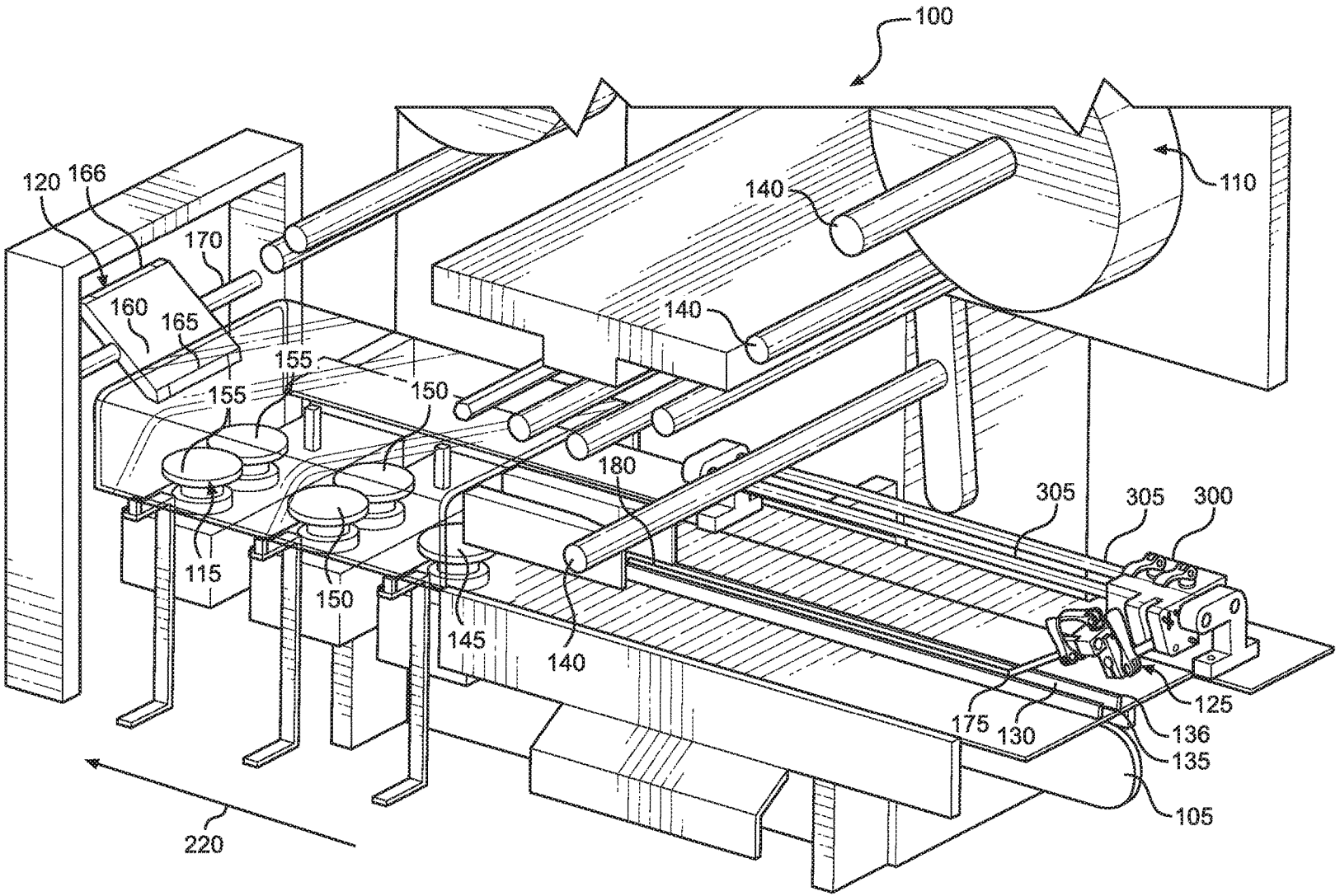
FIG. 3 is a perspective view of the system showing the lance in a partially retracted position.

With reference now to FIG. 3, mechanically retractable lance 175 is shown in a partially retracted position. As with the operative positions, there are multiple partially retracted positions corresponding to the positions where mechanically retractable lance 175 is not in one of the operative positions and also not in a fully retracted position, which is discussed below in connection with FIG. 4. Preferably, lance 175 is retractable to a partially retracted position where mechanically retractable lance 175 does not extend vertically above first sealer 115 at all, as shown in FIG. 3. Such a position is beneficial in that it enables a worker to handle packaging material 205 more easily if packaging material 205 becomes jammed in first sealer 115, for example. If mechanically retractable lance 175 were not retractable (i.e., if mechanically retractable lance 175 were fixed in the position shown in FIGS. 1 and 2), the worker would need to carefully remove packaging loop 225 from this non-retractable lance to clear the jam. This adds time to the procedure, reducing the number of food products 200 that can be packaged in a given amount of time. Additionally, if the worker were to damage the non-retractable lance, such lances are expensive to replace. Accordingly, it should be recognized that the ability of mechanically retractable lance 175 to be repositioned out of packaging loop 225, and away from packaging material 205, is advantageous.

To provide the desired retractability in the illustrated embodiment, mechanically retractable lance 175 is mounted to a mounting block 300, which is configured to slide along rails 305, as discussed in more detail below in connection with FIG. 5. Rails 305 are aligned parallel to direction of travel 220 of packaging material 205 so that mechanically retractable lance 175 can be repositioned along direction of travel 220. In addition to the advantages discussed above, this allows for precise positioning of tip 180 of mechanically retractable lance 175 relative to packaging loop 225, as well as on-the-fly adjustments. Depending on the fluid dynamics of the system, it can be desirable to position tip 180 closer to or further from second sealer 120 within the range of operative positions, i.e., at different positions between where seals 215 and 230 are formed. For example, the positioning of tip 180 depends on the amount of empty space in packaging loop 225 and the flow rate of the gas exiting mechanically retractable lance 175.

Figure 4:
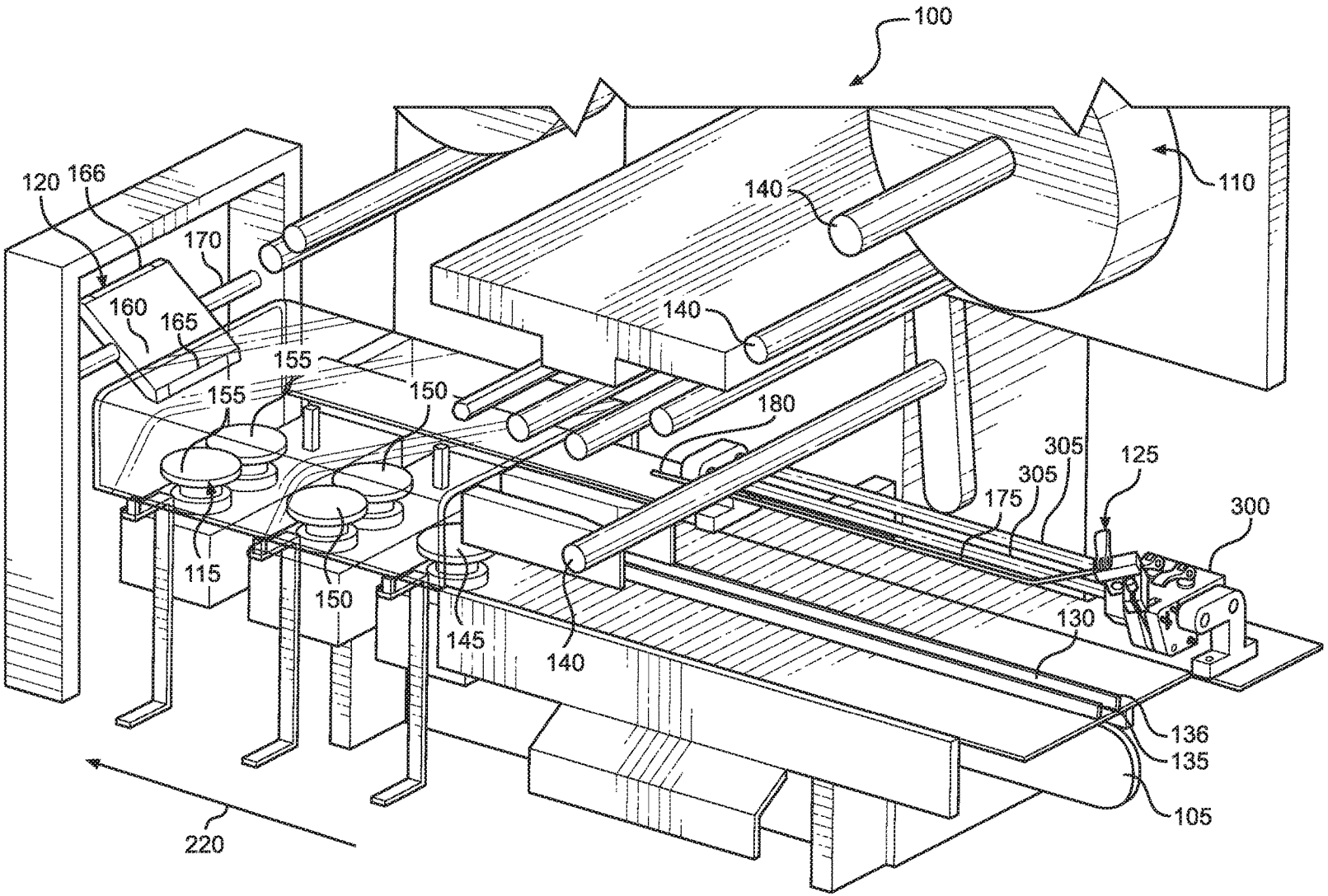
FIG. 4 is a perspective view of the system showing the lance in a fully retracted position.

Turning to FIG. 4, mechanically retractable lance 175 is shown in a fully retracted position. For purposes of the present invention, fully retracted positions are those where mechanically retractable lance 175 has also been moved in a plane perpendicular to direction of travel 220, e.g., laterally. In other words, mechanically retractable lance 175 has been moved to the side, away from packaging material 205, so that even tip 180 of mechanically retractable lance 175 is not directly below packaging material 205. As with the shifting of mechanically retractable lance 175 in direction of travel 220, this helps ensure that mechanically retractable lance 175 is out of the way of a worker who wishes to handle packaging material 205 (or otherwise interact with packaging system 100). Although mechanically retractable lance 175 is shown at its furthest right position (relative to FIG. 4), mechanically retractable lance 175 can be placed into a fully retracted position without being shifted all the way to the right end of rails 305.

Figure 5:
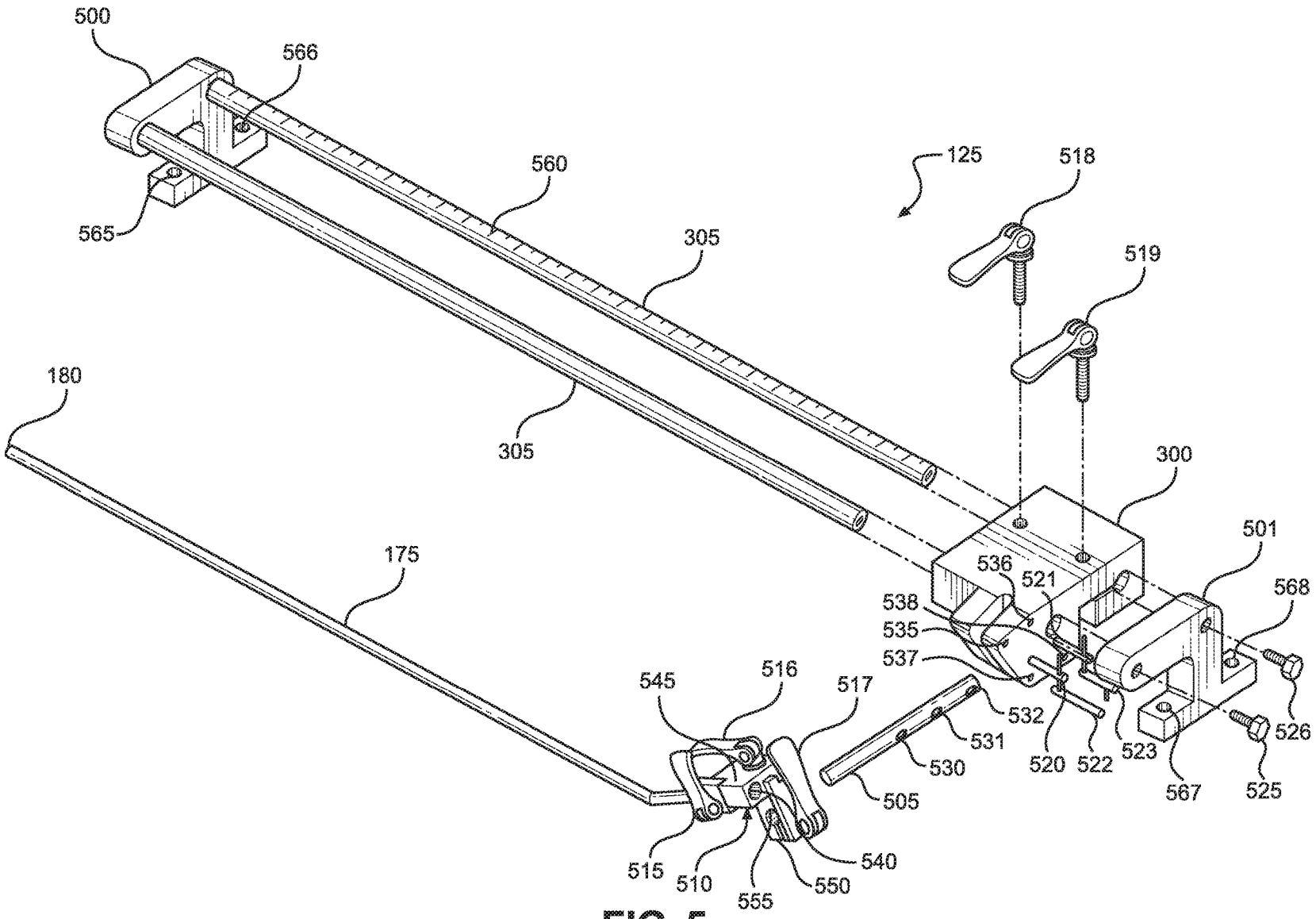
FIG. 5 is a perspective exploded view of a gas flushing mechanism of the system.

With reference now to FIG. 5, an exploded view of gas flusher 125 is provided. In addition to mechanically retractable lance 175, mounting block 300 and rails 305, gas flusher 125 includes rail mounts 500 and 501, a mounting shaft 505, a mounting head 510, handles 515-519, pins 520-523 and fasteners 525 and 526. Rail mounts 500 and 501 are configured to attach rails 305 to the rest of packaging system 100 such that rails 305 are fixed in place, with mounting block 300 being movable relative to rails 305. Mounting shaft 505 is configured to provide for full retraction of mechanically retractable lance 175 using holes 530-532, holes 535-538 formed in mounting block 300 and pins 520-523. In particular, when assembled, pin 522 extends through holes 531 and 537 and acts as a pivot axis for mounting shaft 505. In one position, pin 523 extends through holes 532 and 538 to hold mounting shaft 505 horizontal, as shown in FIGS. 1-3. In another position, pin 520 extends through holes 530 and 535 to hold mounting shaft 505 closer to vertical, as shown in FIG. 4. In a further position, pin 521 extends through holes 530 and 536 to hold mounting shaft 505 vertical. This arrangement enables mechanically retractable lance 175 to be moved in a plane perpendicular to direction of travel 220 between partially and fully retracted positions (or, using a different reference point, mechanically retractable lance 175 is movable in a plane perpendicular to the longitudinal axes of rails 305). Of course, it should be recognized that other arrangements can be used to provide such movement for mechanically retractable lance 175.

Mounting head 510 is configured to releasably attach mechanically retractable lance 175 to the rest of gas flusher 125. Specifically, this is accomplished using handle 515, which selectively locks mechanically retractable lance 175 in place. If mechanically retractable lance 175 needs to be replaced for some reason, it can be swapped out by turning handle 515 without the need to replace any other part of gas flusher 125, reducing the cost of such replacement. Gas flows into mechanically retractable lance 175 through mounting head 510, with the gas entering mounting head 510 through an inlet 540 that is preferably connected to a gas source via a flexible hose (not shown).

Mounting head 510 is also configured to provide adjustability. Handle 516 selectively locks a first portion 545 of mounting head 510 in place relative to a second portion 550 of mounting head 510 so that the relative position of portions 545 and 550 can be changed, allowing the height of mechanically retractable lance 175 above conveyor 105 to be adjusted. Mounting shaft 505 is received in a hole 555 in mounting head 510. Handle 517 selectively locks mounting head 510 in place relative to mounting shaft 505 so that the axial and rotational positions of mounting head 510 relative to mounting shaft 505 can be adjusted. While mounting head 510 does provide multiple means of adjustment in the embodiment illustrated, this adjustment is not necessary for the present invention if gas flusher 125 is specifically designed for a particular packaging system.

Handles 518 and 519 can be used to selectively lock mounting block 300 in place along rails 305 so that mechanically retractable lance 175 can be held in place after being moved to a desired position. To help ensure that mechanically retractable lance 175 is placed in the ideal operative position after being repositioned, rails 305 can include a scale 560. Preferably, scale 560 is configured to indicate a distance of tip 180 from second sealer 120. Accordingly, if for a given product line, it is determined that tip 180 should be placed one inch from second sealer 120 during operation, a worker repositioning mechanically retractable lance 175 after dealing with a jam, for example, can place mounting block 300 at the one-inch mark on scale 560. For the embodiment illustrated, the zero-distance mark would be at the left end of scale 560 (relative to FIG. 5), with the distance increasing to the right, since second sealer 120 is located to the left of gas flusher 125.

Fasteners 525 and 526 couple rails 305 to rail mount 501. Corresponding fasteners (not visible) couple rails 305 to rail mount 500. Additional fasteners (not shown) are inserted through holes 565-568 in rail mounts 500 and 501 to couple rail mounts 500 and 501 to the rest of packaging system 100.

Lance 175 has been described as "mechanically retractable". For purposes of the present invention, "mechanically retractable" means that lance 175 is retracted using a mechanical mechanism, e.g., mounting block 300 and rails 305. This language is not intended to encompass a worker manually removing a lance that is attached to a packaging system in a fixed position nor is it intended to encompass the worker repositioning the lance by, for example, detaching the lance from the fixed position and reattaching the lance at another position.

Based on the above, it should be readily apparent that the present invention provides a gas flushing arrangement, utilizing a mechanically retractable lance, where the time needed to deal with packaging issues is minimized. In addition, the gas flushing arrangement minimizes the risk of damage to the lance when addressing such issues. While certain preferred embodiments of the present invention have been set forth, it should be understood that various changes or modifications could be made without departing from the spirit of the present invention. In general, the invention is only intended to be limited by the scope of the following claims.

The invention claimed is:

1. A packaging system comprising:

a first sealer configured to create a first seal in packaging material along a direction of travel of the packaging material during a packaging operation, thereby forming a packaging loop; and a gas flusher configured to flush ambient air from within the packaging loop during the packaging operation, wherein the gas flusher includes a mechanically retractable lance configured to: project, while fixed in an operative position during the packing operation, in the packaging loop; and be selectively repositioned relative to the first sealer into a retracted position away from the packaging material during stoppage of the packaging operation.

2. The packaging system of claim 1, wherein the gas flusher is configured such that, when the mechanically retractable lance is in the operative position, a gas can flow through the mechanically retractable lance into the packaging loop during the packaging operation.

3. The packaging system of claim 2, wherein the gas flusher is configured such that, when the mechanically retractable lance is in the operative position, the mechanically retractable lance extends vertically above the first sealer, and, when the mechanically retractable lance is in the retracted position, the mechanically retractable lance does not extend vertically above the first sealer.

4. The packaging system of claim 1, wherein the packaging system is configured such that the first sealer forms the packaging loop around at least one food product being conveyed through the packaging system.

5. The packaging system of claim 4, wherein the gas flusher is configured such that, when the mechanically retractable lance is in the operative position, the mechanically retractable lance extends vertically above the at least one food product within the packaging loop.

6. The packaging system of claim 1, wherein the gas flusher includes a rail and a mounting block configured to slide along the rail, and the mechanically retractable lance is mounted to the mounting block such that the mechanically retractable lance is movable along the rail.

7. The packaging system of claim 6, further comprising a second sealer configured to create a second seal in the packaging loop perpendicular to the direction of travel of the packaging material, thereby forming an individual package, wherein the rail has a scale configured to indicate a distance of a tip of the mechanically retractable lance from the second sealer.

8. The packaging system of claim 6, wherein the mechanically retractable lance is movable in a plane perpendicular to a longitudinal axis of the rail.

9. The packaging system of claim 1, wherein the mechanically retractable lance is movable along a longitudinal axis of the mechanically retractable lance between the operative position and a partially retracted position, and the mechanically retractable lance is pivotable between the partially retracted position and a fully retracted position.

10. The packaging system of claim 1, further comprising a second sealer configured to create a second seal in the packaging loop perpendicular to the direction of travel of the packaging material, thereby forming an individual package.

11. The packaging system of claim 1, wherein the first sealer includes:

a first pair of wheels configured to press a first portion of the packaging material into contact with a second portion of the packaging material, thereby establishing the packaging loop; and a second pair of wheels configured to create the first seal in the packaging material by sealing the first portion of the packaging material to the second portion of the packaging material, thereby forming the packaging loop.

12. A method of packaging at least one product being conveyed through a packaging system during a packaging operation, the method comprising:

during the packaging operation:

creating a first seal in packaging material along a direction of travel of the packaging material with a first sealer, thereby forming a packaging loop around the at least one product; and flushing ambient air from the packaging loop with a gas flusher including a mechanically retractable lance projecting, while fixed in an operative position during the packaging operation, in the packaging loop; and during stoppage of the packaging operation:

selectively repositioning the mechanically retractable lance relative to the first sealer into a retracted position away from the packaging material.

13. The method of claim 12, wherein flushing the ambient air from the packaging loop includes causing a gas to flow through the mechanically retractable lance into the packaging loop during the packaging operation.

14. The method of claim 13, wherein the gas flusher is configured such that, when the mechanically retractable lance is in the operative position, the mechanically retractable lance extends vertically above the first sealer and, when the mechanically retractable lance is in the retracted position, the mechanically retractable lance does not extend vertically above the first sealer.

15. The method of claim 12, wherein the mechanically retractable lance, when in the operative position, extends vertically above the at least one product.

16. The method of claim 12, wherein the gas flusher includes a rail and a mounting block configured to slide along the rail, and the mechanically retractable lance is mounted to the mounting block, the method further comprising moving the mechanically retractable lance along the rail between the operative and retracted positions.

17. The method of claim 16, further comprising creating a second seal in the packaging loop perpendicular to the direction of travel of the packaging material with a second sealer, thereby forming an individual package, wherein the rail has a scale configured to indicate a distance of a tip of the mechanically retractable lance from the second sealer.

18. The method of claim 16, further comprising moving the mechanically retractable lance in a plane perpendicular to a longitudinal axis of the rail.

19. The method of claim 12, further comprising:

moving the mechanically retractable lance along a longitudinal axis of the mechanically retractable lance between the operative position and a partially retracted position; and pivoting the mechanically retractable lance between the partially retracted position and a fully retracted position.

20. The method of claim 12, further comprising creating a second seal in the packaging loop perpendicular to the direction of travel of the packaging material with a second sealer, thereby forming an individual package.

* * * * *